United States Patent [19]

Bringman et al.

[11] 4,121,306

[45] Oct. 24, 1978

[54] URINAL

[76] Inventors: Bernard B. Bringman; Genevieve M. Goodwin, both of 1111 N. 8th St., Boise, Id. 83702

[21] Appl. No.: 787,892

[22] Filed: Apr. 15, 1977

[51] Int. Cl.[2] ..... A61G 9/00

[52] U.S. Cl. ..... 4/144.2; 128/2 F; 128/295; 4/144.3

[58] Field of Search ..... 4/110; 128/2 F, 275, 128/295

[56] References Cited

U.S. PATENT DOCUMENTS

| | | | |
|---|---|---|---|
| 137,214 | 3/1873 | Knight et al. | 4/110 |
| 3,114,916 | 12/1963 | Hadley | 4/110 |
| 3,161,891 | 12/1964 | Bauman | 4/110 |
| 3,362,400 | 1/1968 | Bella | 128/2 F |
| 3,422,463 | 1/1969 | Lowry | 4/110 |
| 3,725,962 | 4/1973 | Gouget | 4/110 |
| 3,964,111 | 6/1976 | Packer | 4/110 |
| 3,998,228 | 12/1976 | Poidomani | 128/295 |
| 4,020,843 | 5/1977 | Kanall | 4/110 |
| 4,050,103 | 9/1977 | Nakao et al. | 4/110 |

*Primary Examiner*—Charles E. Phillips
*Attorney, Agent, or Firm*—Paul F. Horton

[57] ABSTRACT

A urinal comprising a conical shaped body portion having an opening at its terminal apex, a conduit connected at one end at the apex and having a distally disposed three way valve and a remote reservoir. Also included is a flexible, conical shaped liner having a hose at its terminal apex which frictionally engages the terminal apex of the body portion, a sample container and means for connecting the sample container to the valve.

6 Claims, 3 Drawing Figures

URINAL

BACKGROUND OF THE INVENTION

1. Field of the Invention

This invention relates in general to urinals and in particular urinals having a remote reservoir and sample obtaining means.

2. Description of the Prior Art

The usefulness of urinals for bedfast patients has long been recognized. Conventional urinals for male patients generally comprise a fluid receptacle having a narrow tubular opening to prevent spilling. More recent advances in the art, to overcome disadvantages of spilling and odor include urinals connected by conduit to a remote reservior. Odor and cleanliness continue to be a problem with the remote reservoir type of urinals. An additional problem associated with the remote reservoir type of urinal is that of obtaining fresh urine samples for analysis.

SUMMARY OF THE INVENTION

The present invention comprises, generally, a urinal having a urine receiving body portion, a remote reservoir connected by conduit; a removable liner for the urinal; and a three-way valve in the conduit for obtaining urine specimens.

It is therefore an object of the present invention to provide a urinal with remote reservoir having a release valve, located between the body portion of the urinal and the remote reservoir, for obtaining fresh urine specimens.

Another object of the present invention is to provide a urinal with a detachable sample container.

Another object of the present invention is to provide a urinal with a manual shut-off valve located between reservoir and body portion to prevent undesirable odors from escaping the reservoir.

Still another object of the present invention is to provide a urinal having a disposable liner to eliminate odors and to maintain cleanliness.

Additional objects and advantages will become apparent and a more thorough and comprehensive understanding may be had from the following description taken in comjunction with the accompanying drawings forming a part of this specification.

DETAILED DESCRIPTION OF THE INVENTION

Figure 1:
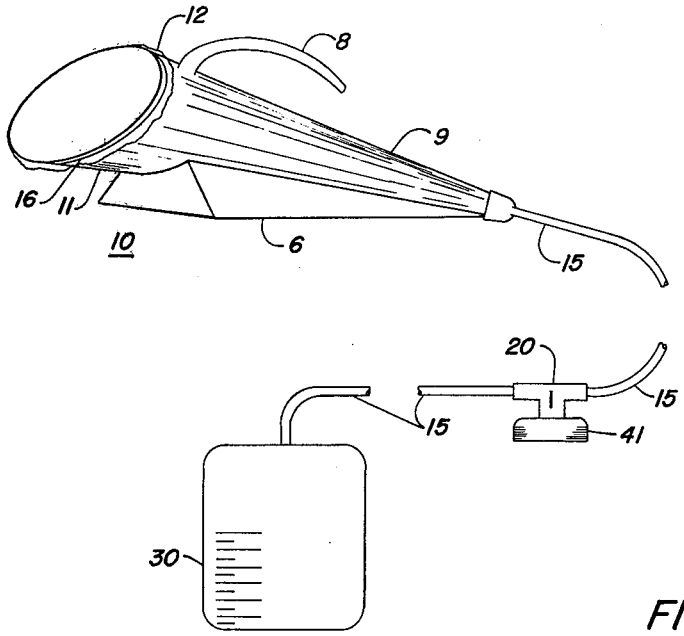
FIG. 1 is an elevated perspective view of the body portion of the urinal, also showing conduit, valve, liner, and reservoir.

Referring now to the drawings, and, more particularly, to FIG. 1, and embodiment of urinal 10, made according to the present invention is disclosed. Urinal 10 includes body portion 11, liner 12, conduit 15, valve 20, and reservoir 30.

Body portion 11 is preferably of unitary construction and comprises a tapered, substantially conical shaped cylinder 9, a handle 8 and an integral base 6 having a planar undersurface. Base 6 is tapered both vertically and horizontally. The planar undersurface is wider at the head of the cone and becomes progressively narrower toward the apex. The planar undersurface is also wider at any particular point than the vertically spaced contact point between base 6 and cylinder 9. Purpose of the dual taper is to provide maximum contact between the undersurface of the base and the object upon which it is placed while maintaining lightness of weight.

Figure 2:
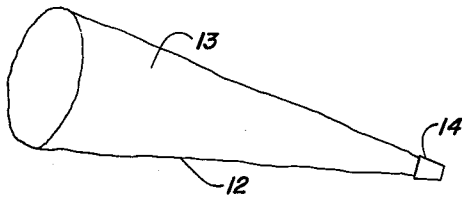
FIG. 2 is an elevated view of the liner.

Inserted into cylinder 9 of the urinal is disposable liner 12, shown to advantage in FIG. 2. Liner 12 comprises a thin, flexible, conical shaped bag portion 13 and a thicker, less flexible hose portion 14 which may either be integral with the bag portion or otherwise suitable fastened. Hose portion 14 is conical in shape, having a hole substantially in the center thereof for allowing urine passage to conduit 15. Hose portion 14 is flexible to allow a snug water tight fit at the interior apex terminal end of the cylinder. The liner is of sufficient length to cover the complete interior of the body and allow encirlement of the crown portion of cylinder 9 which then may be attached by rubberband, adhesive tape, or otherwise. An elastic band 16 is sewn or sealed adjacent the terminal edge of the liner in the preferred embodiment as shown in FIG. 1. A liner made of polyethylene having an electrical affinity for interior of cylinder 9 is the preferred material for liner construction.

Conduit 15 receives the urine either from liner 12 or from cylinder 9 and conducts it to valve 20 and from the valve to reservoir 30. Conduit 15 is made of conventional flexible tubing such as plastic or rubber. The conduit fastens to other parts of device 10 in a standard manner by frictional engagement or by other coupling means.

Figure 3:
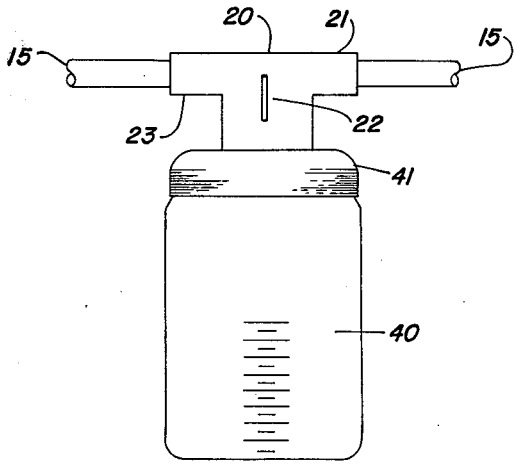
FIG. 3 is a side view of the sample bottle and its attachment to the valve.

Referring now to FIG. 3, valve 20, a manually operated three-way valve comprising an inlet 21 an two outlets 22 and 23, may be seen. Outlet 23 conducts urine on to reservoir 30, while outlet 22 conducts the urine to sample container 40. Valve 20 is equipped at outlet 22 with sample collector connection means 41 which is detachably engageable with sample container 40. It is preferred that connector means 41 be a threaded lid adapted to receive the mating threads of sample bottle 40. Lid 41 may be integrally constructed with the valve or may be attached by welding or otherwise. Reservoir 40 is a standard urine receiving bag, conventional in the art.

For operation, liner 12 is installed into cylinder 9 with the hand, making sure of good contact between hose 14 and the interior apex of the cylinder. The other terminal end of liner 12 is stretched about the exterior surface of the crown of body portion 11, as shown in FIG. 1. Conduit 15 is suitably attached and valve 20 is turned to allow urine flow to reservoir 30. If a fresh urine sample is desired for analysis, valve 20 is adjusted to allow urine flow to attached sample bottle 40 and then subsequently readjusted for normal disposal. Liners 12 may be removed and replaced at will. In addition, valve 20 may be turned to a position to completely shut off reservoir 30 to prevent undesirable odors from escaping, especially during periods of visitation and the like.

Having thus described in detail a preferred selection of embodiments of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

We claim:

1. A urinal comprising:

a substantially conical shaped cylinder including an integral base portion having a planar undersurface for support, said cylinder having an opening at the terminal apex thereof;

a conduit connected at one end to the terminal apex of said cylinder communicating with the opening and connected at the other end to a remote reservoir;

a three way valve disposed within said conduit, said valve having one inlet and two outlets;

a remote reservoir communicating with one of the outlets; and a liner having a thin, flexible, substantially conical shaped bag portion for engaging the interior of said cylinder and a flexible hose portion, conical in shape and having a centrally disposed conduit for urine passage, the hose portion adapted to sealingly engage the interior of said cylinder adjacent its terminal apex.

2. The urinal as described in claim 1 further comprising:

sample collection connector means communicating with the other outlet; and a sample collection container for transporting urine specimens removably secured to said connector.

3. The urinal as described in claim 2 wherein said sample collection connector means comprises a screw-type jar lid immovably secured to said valve and wherein said sample collection container comprises a jar detachably engaging said lid.

4. The urinal as described in claim 1 wherein the bag portion of said liner is fabricated from a material having an electrostatic affinity for the inner wall of said cylinder.

5. A urinal comprising:

substantially conical shaped cylinder including an integral base portion having a planar undersurface for support, said cylinder having an opening at the terminal apex thereof;

a conduit connected at one end to the terminal apex of said cylinder communicating with the opening and connected at the other end to a remote reservoir;

a three way valve disposed within said conduit, said valve having one inlet and two outlets;

a remote reservoir communicating with one of the outlets;

a sample collector connection lid secured to said valve and communicating with the other outlet;

a sample collection container for transporting urine specimens, removably secured to said lid; and a liner having a thin, flexible, substantially conical shaped bag portion for engaging the interior of said cylinder, and a flexible hose portion, conical in shape and having a centrally disposed conduit for urine passage, the hose portion adapted to sealingly engage the interior of said cylinder adjacent its terminal apex.

6. The urinal as described in claim 5 wherein the bag portion of said liner is fabricated from a material having an electrostatic affinity for the inner wall of said cylinder.

* * * * *